US005497848A

United States Patent [19]

Travis

[11] Patent Number: 5,497,848

[45] Date of Patent: Mar. 12, 1996

[54] LADDER MOUNTED GUTTER PROTECTORS

[76] Inventor: Walton L. Travis, 4217 Maple Ave., Fairfax, Va. 22032

[21] Appl. No.: 337,082

[22] Filed: Nov. 10, 1994

[51] Int. Cl.[6] ..... E06C 7/48

[52] U.S. Cl. ..... 182/107; 182/214

[58] Field of Search ..... 182/107, 214, 182/228; 248/48.2, 300

[56] References Cited

U.S. PATENT DOCUMENTS 4,000,587 1/1977 Weber ..... 248/48.1

5,358,071 10/1994 Stennett ..... 182/214

*Primary Examiner*—Alvin C. Chin-Shur

[57] ABSTRACT

A ladder mounted gutter protector comprising: a ladder protector formed in a planar configuration and shaped into a generally L-shaped orientation, the protector having an upper region, a lower region, and a central region therebetween, the lower region being formed in a generally rectangular configuration, the central region being shaped in a generally planar configuration and formed contiguously with the lower region, the central region being slanted from the lower region at an angle of between about one hundred and one hundred and eighty degrees, the upper region being formed in a generally J-shaped orientation, the long portion of the J extending from the long side edge of the central region at an angle of between about forty-five and one hundred and thirty-five degrees, the apparatus adapted to be coupled to a ladder in the operative orientation, the apparatus permitting the user to position a ladder against a house or building without damaging adjacent gutters.

2 Claims, 4 Drawing Sheets

FIG 1
PRIOR ART
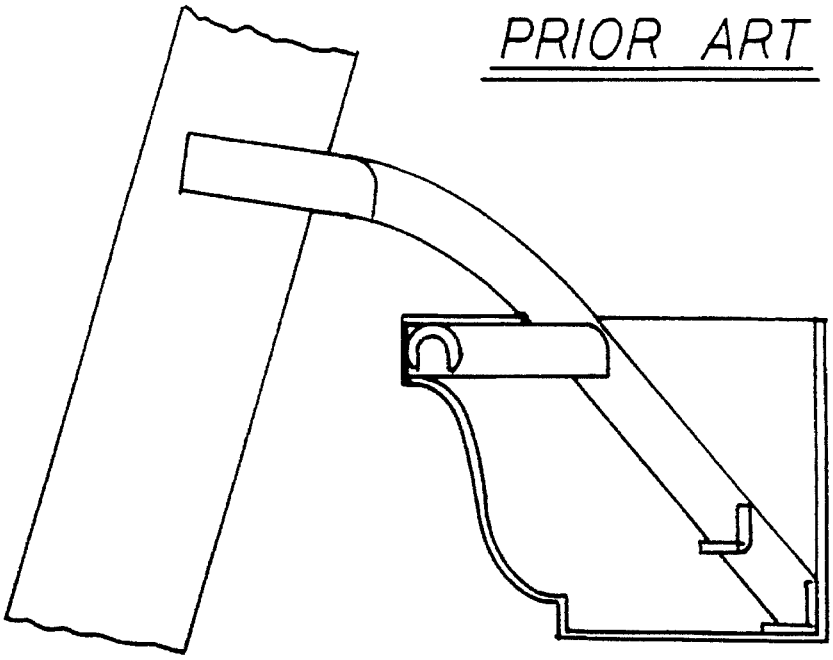
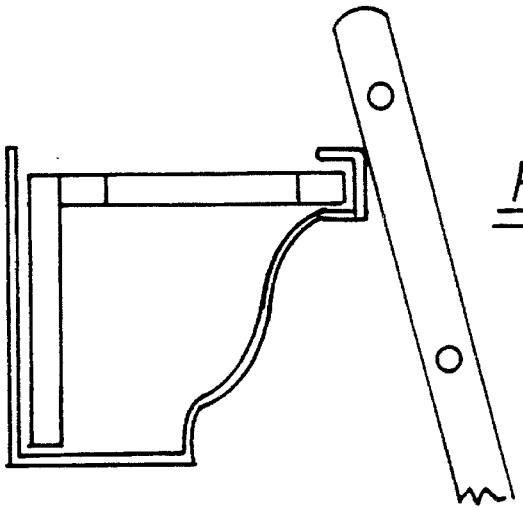
FIG 2
PRIOR ART

FIG 5
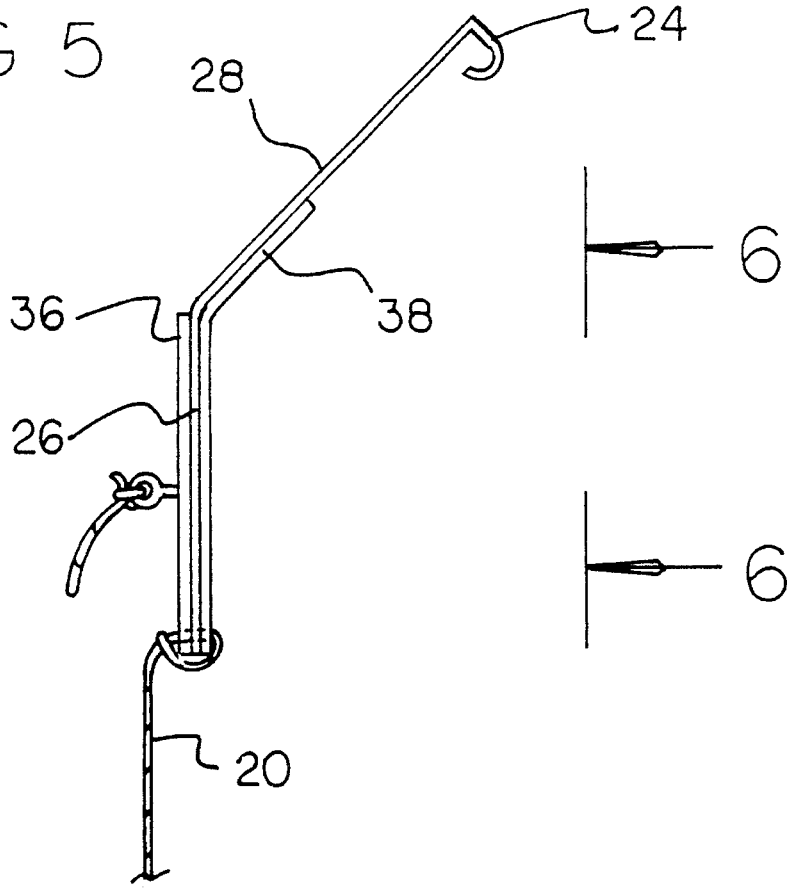
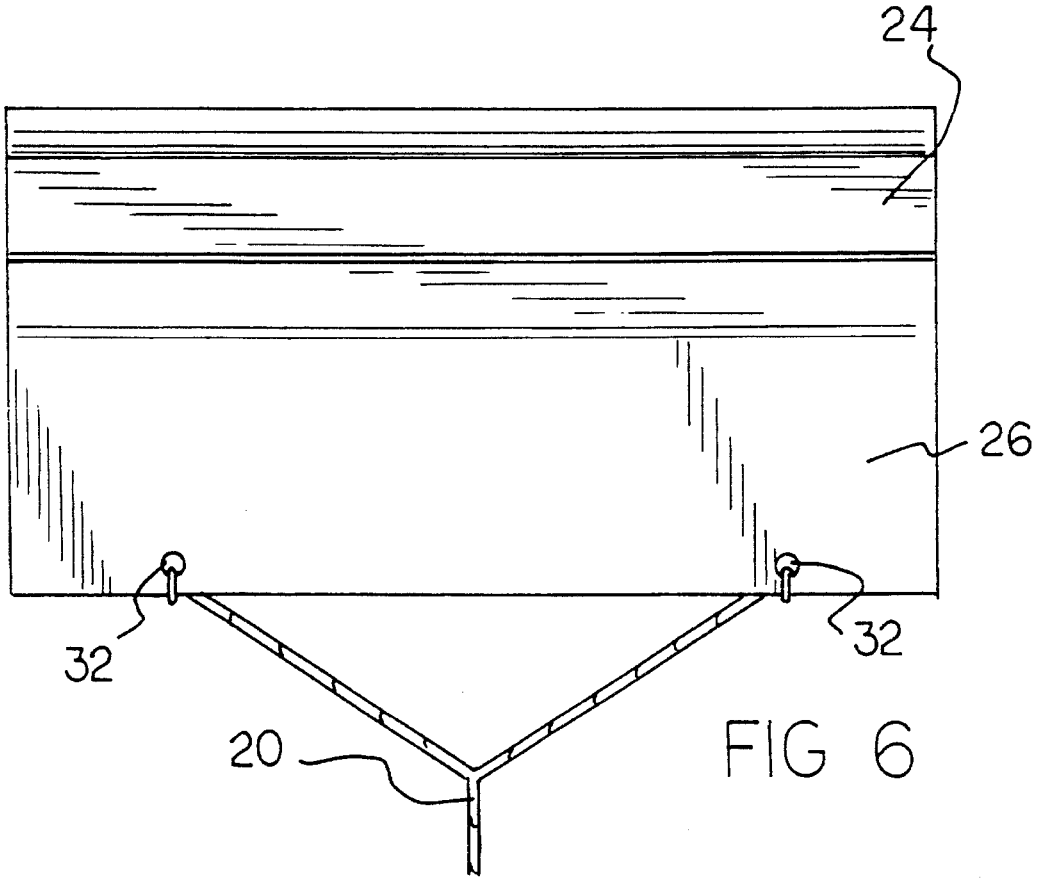
FIG 6

LADDER MOUNTED GUTTER PROTECTORS

BACKGROUND OF THE INVENTION

1. Field of the Invention

The present invention relates to ladder mounted gutter protectors and more particularly pertains to protecting roof gutters from damage when leaning ladders against the roofs of houses and buildings.

2. Description of the Prior Art

The use of ladder supports is known in the prior art. More specifically, ladder supports heretofore devised and utilized for the purpose of preventing damage to various types of structures when leaning ladders against them are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,185,421 to Robinson a gutter protector assembly.

U.S. Pat. No. 5,215,163 to Kent, Sr., et al., discloses a ladder support.

U.S. Pat. No. 5,169,098 to Samuelson discloses a gutter-buddy and ladder guide.

U.S. Pat. No. 4,714,136 to Morin discloses a ladder support for eavestrough or gutter.

Lastly, U.S. Pat. No. 4,601,365 to Davis discloses a rain gutter ladder support.

In this respect, the ladder mounted gutter protectors according to the present invention substantially departs from the conventional concepts and designs of the prior art, and in doing so provides an apparatus primarily developed for the purpose of protecting roof gutters from damage when leaning ladder against the roofs of houses and buildings.

Therefore, it can be appreciated that there exists a continuing need for new and improved ladder mounted gutter protectors which can be used for protecting gutters from damage when leaning ladders against the roofs of houses and buildings. In this regard, the present invention substantially fulfills this need.

SUMMARY OF THE INVENTION

In view of the foregoing disadvantages inherent in the known types of ladder supports now present in the prior art, the present invention provides improved ladder mounted gutter protectors. As such, the general purpose of the present invention, which will be described subsequently in greater detail, is to provide a new and improved ladder mounted gutter protector and method which has all the advantages of the prior art and none of the disadvantages.

To attain this, the present invention essentially comprises a new and improved ladder mounted gutter protector comprising, in combination: a gutter protector fabricated of lightweight metal and formed in a planar generally rectangular configuration, the protector being configured in a generally L-shaped orientation, the protector having an upper region, a lower region, and a central region therebetween, the lower region being formed in a planar generally rectangular configuration with parallel short side edges and parallel long side edges, the long side edges being positioned horizontally and the short side edges being positioned vertically in the operative orientation, the lower region having two apertures, one being centrally positioned adjacent to each short side edge, the lower region also having two holes near its lower long side edge and positioned inwardly with respect to the centrally positioned apertures thereabove, the centrally positioned apertures in the lower region having bolts with ring shaped heads positioned therethrough, the bolts being firmly secured through the apertures with cooperatively coupled nuts; the central region of the apparatus being formed contiguously with the upper and lower regions and having parallel long side edges and parallel short side edges, the central region having its lower long side edge formed contiguously with the upper long side edge of the lower region, the central region being slanted from the lower region at an angle of approximately one hundred and forty degrees, the upper region of the apparatus being formed in a planar configuration and shaped in a generally J-shaped orientation, the long portion of the J being formed contiguously with the long side edge of the central region and extending therefrom at approximately a ninety degree angle, the hooked portion of the J being of a generally semi-circular shape and extending upwardly a short distance from its rounded lowermost portion thereof, the upper region of the apparatus adapted to be positioned upon the roofs of houses and buildings, the angle of the apparatus permitting the user to lean a ladder against roofs of various structures without damaging adjacent gutters; the apparatus including a Y-shaped rope with two free ends at one extent and one free end at the other extent, the rope having a length at least equal to that of the ladder coupled thereto, the holes in the lower region adapted to permit the coupling of both free ends of the upper extent of the Y-shaped rope thereto; and a flexible tension cord with two free ends, the free ends of the tension cord being coupled to the ring heads of the bolts in the lower region of the apparatus, the tension cord adapted to be positioned around the rungs of a ladder in the operative orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved ladder mounted gutter protectors which have all the advantages of the prior art ladder supports and none of the disadvantages.

It is another object of the present invention to provide new and improved ladder mounted gutter protectors which may be easily and efficiently manufactured and marketed.

It is further object of the present invention to provide new and improved ladder mounted gutter protectors which are of durable and reliable constructions.

An even further object of the present invention is to provide new and improved ladder mounted gutter protectors which are susceptible of a low cost of manufacture with regard to both materials and labor, and which accordingly are then susceptible of low prices of sale to the consuming public, thereby making such ladder mounted gutter protectors economically available to the buying public.

Still yet another object of the present invention is to provide new and improved ladder mounted gutter protectors which provide in the apparatuses and methods of the prior art some of the advantages thereof, while simultaneously overcoming some of the disadvantages normally associated therewith.

Still another object of the present invention is to protect roof gutters from damage when leaning ladders against the roofs of houses and buildings.

Lastly, it is an object of the present invention to provide a new and improved ladder mounted gutter protector comprising: a ladder protector formed in a planar configuration and shaped into a generally L-shaped orientation, the protector having an upper region, a lower region, and a central region therebetween, the lower region being formed in a generally rectangular configuration, the central region being shaped in a generally planar configuration and formed contiguously with the lower region, the central region being slanted from the lower region at an angle of between about one hundred and one hundred and eighty degrees, the upper region being formed in a generally J-shaped orientation, the long portion of the J extending from the long side edge of the central region at an angle of between about forty-five and one hundred and thirty-five degrees, the apparatus adapted to be coupled to a ladder in the operative orientation, the apparatus permitting the user to position a ladder against a house or building without damaging adjacent gutters.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIGS. 1 and 2 are illustrations of prior art ladder supports

FIG. 5 is a side perspective view of the apparatus shown in FIG. 3.

FIG. 6 is a front perspective view of the apparatus taken along line 6—6 of FIG. 5.

The same reference numerals refer to the same parts through the various Figures.

DESCRIPTION OF THE PREFERRED EMBODIMENT

Figure 3:
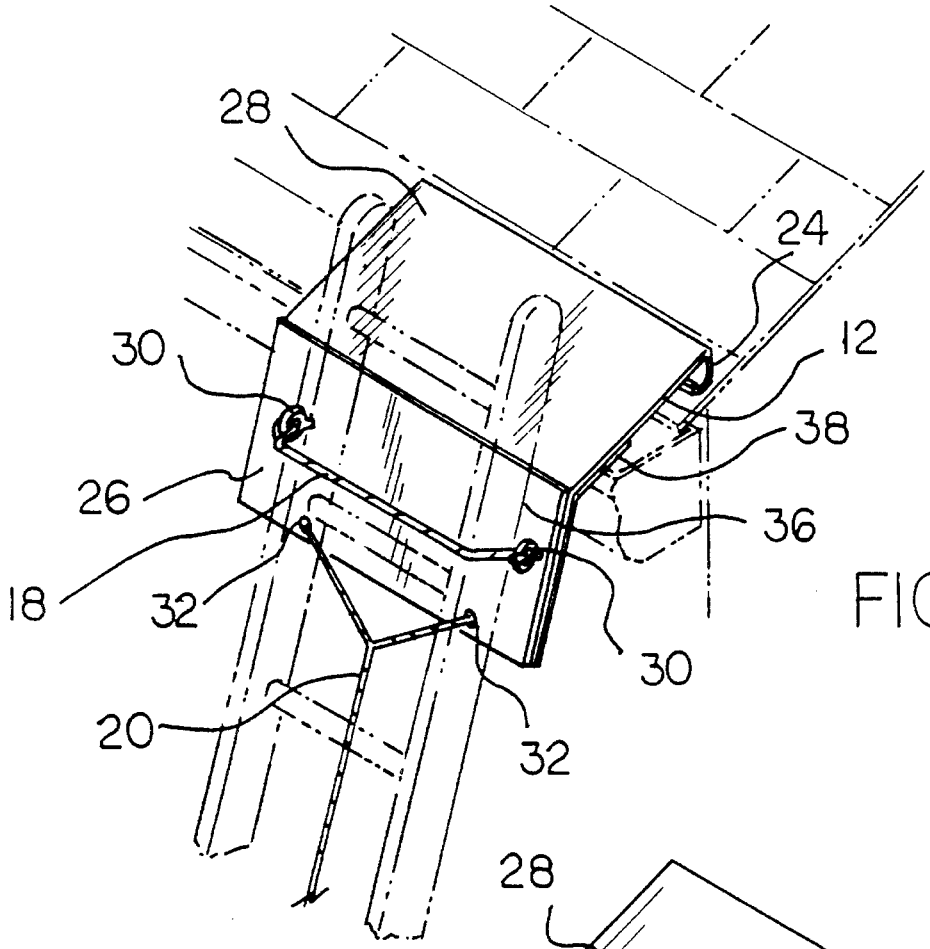
FIG. 3 is a perspective view of the preferred embodiment of the ladder mounted gutter protector constructed in accordance with the principles of the present invention.

With reference now to the drawings, and in particular to FIG. 3 thereof, the preferred embodiment of the new and improved ladder mounted gutter protector embodying the principles and concepts of the present invention and generally designated by the reference numeral 10 will be described.

The present invention, the ladder mounted gutter protector 10, is comprised of a plurality of components. Such components in their broadest context include a gutter protector 12, a first rubber pad 36, a second rubber pad 38, a tension cord 18 and a rope 20. Such components are individually configured and correlated with respect to each other so as to attain the desired objective.

More specifically, a gutter protector 12 is fabricated of lightweight metal and formed in a planar generally rectangular configuration. The sturdy metal construction of the apparatus prevents it from bending or breaking. The protector is configured in a generally L-shaped orientation. The protector has an upper region 24, a lower region 26, and a central region 28 therebetween. Note FIG. 3.

Figure 4:
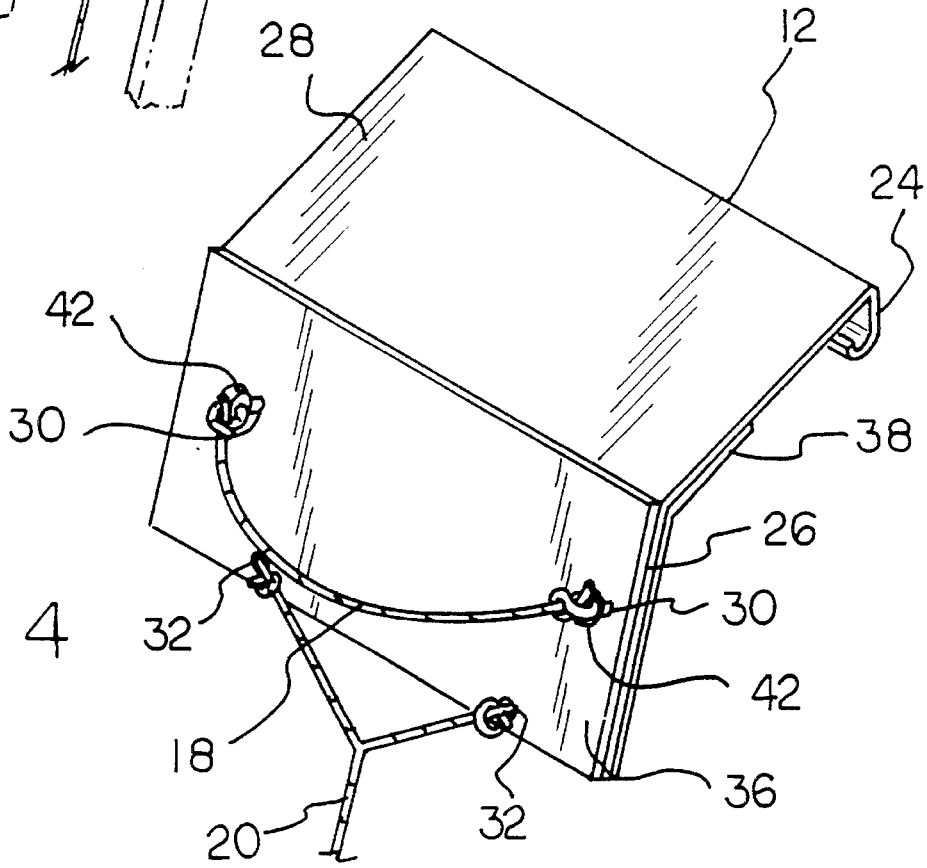
FIG. 4 is a perspective illustration of the apparatus separated from a ladder.

The lower region is formed in a planar, generally rectangular configuration with parallel short side edges and parallel long side edges. The long side edges are positioned horizontally, and the short side edges are positioned vertically in the operative orientation. The lower region has two apertures 30, one being centrally positioned adjacent to each short side edge. The lower region also has two holes 32 near its lower long side edge and positioned is inwardly with respect to the centrally positioned apertures thereabove. The centrally positioned apertures in the lower region have bolts 42 with ring shaped heads positioned therethrough. The bolts are firmly secured through the apertures with cooperatively coupled nuts. The lower region is positioned parallel to and flush with the rungs of a ladder in the operative orientation. Note FIGS. 3, 4 and 6.

The central region 28 of the apparatus is formed contiguously with the upper and lower regions and has parallel long side edges and parallel short side edges. The central region has its lower long side edge formed contiguously with the upper long side edge of the lower region. The central region 28 is slanted from the lower region at an angle of approximately one hundred and forty degrees. The central region extends frontwardly with respect to the rungs of the ladder in the operative orientation. The central region forms a bridge between the ladder and the roof thereby avoiding contact with adjacent gutters. Note FIGS. 3 and 4.

Figure 7:
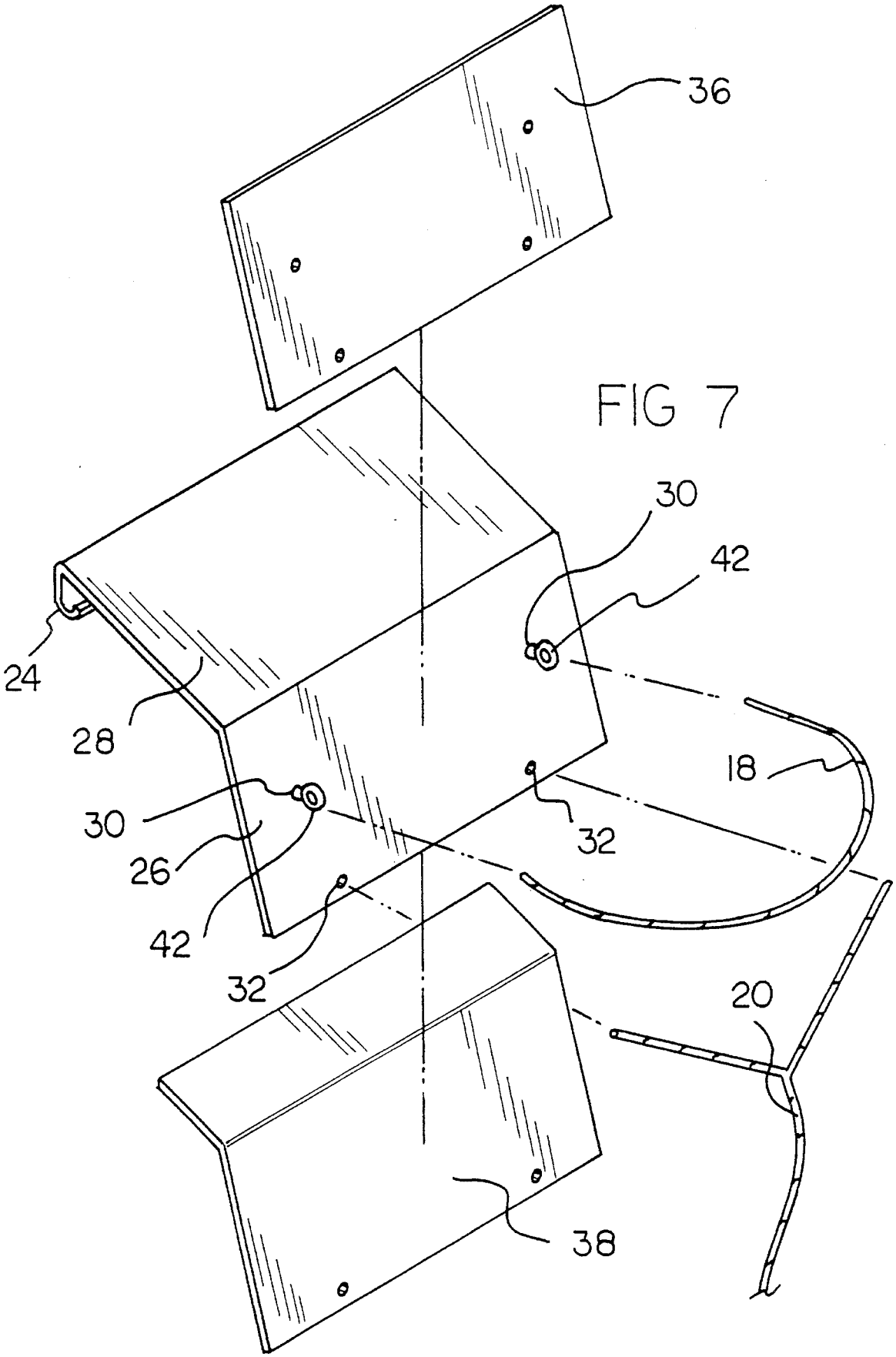
FIG. 7 is a separated perspective view of the apparatus illustrating the placement of the various components of the ladder mounted gutter protector.

The upper region 24 of the apparatus is formed in a planar configuration and is shaped in a generally J-shaped orientation, the long portion of the J is formed contiguously with the long side edge of the central region and extends therefrom at approximately a ninety degree angle. The hooked portion of the J is of a generally semi-circular shape and extends upwardly a short distance from its rounded lowermost portion. The upper region of the apparatus is adapted to be positioned on the roof of a house. The apparatus may also be positioned upon the roof of a building or other structure. The angle of the apparatus permits the user to lean a ladder against the roofs of various structures without damaging adjacent gutters. The apparatus provides added safety to individuals utilizing ladders by eliminating the problem of lateral slippage when leaning the ladder against gutters. Note FIGS. 3, 4 and 7.

The J shaped upper region of the gutter protector serves many different functions. When the protector is pulled downward the upper region is the first part of the protector to come in contact with the roof. The placement of the upper region has two practical effects. First, it automatically positions the protector well above the gutter. Therefore, when the ladder is rested against the gutter the full weight of the ladder will be against the side of the gutter. This orientation prevents the weight of the ladder from being directed downward, thereby damaging the gutter.

Secondly, when the J shaped upper region touches the roof it provides a clearance area between the protector and the top of the gutter. This prevents damage to leaf screens and guards that may be installed on the gutter. Additionally, after the protector is pulled down into position and rested against the gutter, the upper region is pushed forward against the upward angle of the roof shingles. The rounded upper region permits the protector to glide smoothly over the shingles rather than disheveling them and causing possible damage thereto. Lastly, the apparatus provides additional strength and rigidity to the protector.

The apparatus includes a flexible tension cord 18 with two free ends. The free ends of the tension cord are coupled to the ring heads of the bolts 42 in the lower region of the apparatus. The tension cord is adapted to be positioned around the rungs of a ladder in the operative orientation. The cord is of sufficient tension to hold the adaptor firmly on a ladder without slipping downward. The cord also possesses sufficient flexibility to permit it to be pulled downward until properly positioned on the gutter. The apparatus can be pulled in place from ground level by positioning a long Y-shaped rope through the holes in the lower region of the adaptor, with the opposite end extending to the user on the ground. Note FIG. 3 and 6.

The apparatus includes a Y-shaped rope 20 with two free ends at one extent and one free end at the other extent. The rope is constructed of sturdy fiber to diminish the possibility of breakage occurring. The holes 32 in the lower region are adapted to permit the coupling of both free ends of the upper extent of the Y-shaped rope therethrough. The rope is of sufficient length to extend the length of the ladder and enables the user to adjust the apparatus from the ground level. Note FIGS. 3 and 6.

An upper rubber pad 36 and a lower rubber pad 38 are affixed to the gutter protector. The gutter protector has an upper region, a lower region and a central region therebetween. The upper rubber pad 36 is positioned on the upper surface of the lower region. The upper rubber pad has apertures and holes in the same locations as the apertures and holes in the lower region of the gutter protector. The upper rubber pad helps prevent the apparatus from slipping off the ladder during use. The rubber pads also provide a firm gripping surface to the user. Note FIGS. 5 and 7.

The lower rubber pad 38 is shaped in a generally L-shaped configuration. The lower rubber pad is affixed to the lower surface of the lower and central regions. The lower rubber pad also has apertures and holes in alignment with those of the upper rubber pad and lower region of the gutter protector. The lower rubber pad extends across approximately half the length of the central region. The lower rubber pad prevents scratching of gutters during use. The rubber pads also provide a firm gripping surface to the user. Note FIGS. 3 and 5.

Gutters are easily damaged when a conventional ladder is leaned against them. This is a problem for millions of home owners. The ladder mounted gutter protector prevents damage to gutters by minimizing direct contact with them. The apparatus also increases ladder safety by minimizing lateral slippage in areas where the ladder rests against the gutter. The ladder mounted gutter protector has the following features: the shape prevents damage to roof gutters, the design minimizes lateral slippage of ladders where they come in contact with gutters, the apparatus is easily positioned in place on roof gutters, and it fits most standard sized ladders.

The ladder mounted gutter protector is a device used with a ladder to eliminate damage to roof gutters when a ladder is leaned against them. This apparatus consists of a gutter protector, two non-slip rubber pads and an elastic cord to provide tension. A covered coiled spring may be used instead of the elastic cord. A length of light rope or cord is also utilized. The guard is made of lightweight rigid metal or plastic and is about twenty inches long and about ten inches wide.

The apparatus is bent at no more than a one hundred and forty degree angle so that the lower side angle is four inches wide and the top side angle is about six inches wide. The upper region of the apparatus has a J shaped upper region which is about one inch deep. A non-slip rubber pad is attached to the upper surface of the lower four inches of the central region of the protector. Another non-slip rubber pad is fastened to the lower surface of the central region of the protector. The lower pad extends across one half of the upper surface of the protector. The elastic cord is fastened to the upper surface of the lower region of the protector adjacent to the center of each side edge. A rope is fastened to the center of the lower edge of the protector.

To utilize the apparatus, the user first places the protector at the top of the ladder with the upper region facing downward toward the roof. The user then slips the ladder through the tension cord so that the ladder rests on the upper surface of the lower region of the protector. The ladder is then raised to the roof at the proper angle so that the apparatus is positioned above the gutter and the roof. Holding the ladder slightly away from the gutter, the user then pulls down on the rope until the upper region touches the roof. This maneuver automatically positions the protector over and against the gutter. The ladder is then rested against the gutter. If the guard is pulled too far down, the user simply raises the ladder extension one rung higher and repositions the protector.

The apparatus prevents damage to gutters and provides additional safety to users by minimizing lateral slippage of ladders where they come in contact with gutters. The non-slip rubber pad on the lower surface of the protector also helps to prevent lateral slippage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved ladder mounted gutter protector comprising, in combination:

a gutter protector fabricated of lightweight metal, the protector being configured in a generally L-shaped orientation, the protector having an upper region, a lower region, and a central region therebetween, the lower region being formed in a planar generally rectangular configuration with parallel short side edges and parallel long side edges, the long side edges being positioned horizontally and the short side edges being positioned vertically in an operative orientation, the lower region having two apertures, one being centrally positioned adjacent to each short side edge, the lower region also having two holes near its lower long side edge and positioned inwardly with respect to the centrally positioned apertures thereabove, the centrally positioned apertures in the lower region having bolts with ring shaped heads positioned therethrough, the bolts being firmly secured through the apertures with cooperatively coupled nuts;

the central region of the apparatus being formed contiguously with the upper and lower regions and having parallel long side edges and parallel short side edges, the central region having its lower long side edge formed contiguously with the upper long side edge of the lower region, the central region being slanted from the lower region at an angle of approximately one hundred and forty degrees, the upper region of the apparatus being formed in a generally J-shaped orientation, the long portion of the J being formed contiguously with the long side edge of the central region and extending therefrom at approximately a ninety degree angle, the hooked portion of the J being of a generally semi-circular shape and extending upwardly a short distance from its rounded lowermost portion thereof, the upper region of the apparatus adapted to be positioned upon the roofs of houses and buildings, the apparatus permitting the user to lean a ladder against roofs of various structures without damaging adjacent gutters;

the apparatus including a Y-shaped rope with two free ends at an upper extent thereof, the rope having one free end at a lower extent thereof, the rope having a length at least equal to that of the ladder coupled thereto, the holes in the lower region adapted to permit the coupling of both free ends of the upper extent of the Y-shaped rope thereto; and a flexible tension cord with two free ends, the free ends of the tension cord being coupled to the ring heads of the bolts in the lower region of the apparatus, the tension cord adapted to be positioned around the rungs of a ladder in an operative orientation.

2. A ladder mounted gutter protector comprising:

a ladder protector formed in a planar configuration and shaped into a generally L-shaped orientation, the protector having an upper region, a lower region, and a central region therebetween, the lower region being formed in a generally rectangular configuration with upper and lower surfaces, the lower region including a rubber nonslip pad positioned thereon, the rubber pad having a plurality of edges, the rubber pad having apertures at the same distance from its side edges as the lower region of the gutter protector, the lower region of the protector having at least two apertures and further including a flexible tension cord with two free ends, the free ends of the tension cord being cooperatively coupled to the apertures in the lower region of the apparatus, the tension cord adapted to be positioned around the rungs of a ladder in an operative orientation, the central region being shaped in a generally planar configuration and formed contiguously with the lower region, the central region being slanted from the lower region at an angle of between about one hundred and one hundred and eighty degrees, the upper region being formed in a generally J-shaped orientation, the long portion of the J extending from the long side edge of the central region at an angle of between about forty-five and one hundred and thirty-five degrees, the apparatus adapted to be coupled to a ladder in an operative orientation, the apparatus permitting the user to position a ladder against a house or building without damaging adjacent gutters; and the protector including two holes with a Y-shaped rope with two free ends at an upper extent thereof, one free end at a lower extent thereof, the holes being positioned in the lower region and being adapted to permit the coupling of both free ends of the upper extent of the Y-shaped rope thereto.

* * * * *